United States Patent [19]

Ashworth

[11] 4,179,238

[45] Dec. 18, 1979

[54] CENTRIFUGAL PUMPS

[75] Inventor: Stewart I. Ashworth, Vale, Channel Islands

[73] Assignee: Abrasives International Limited, West Midlands, England

[21] Appl. No.: 804,658

[22] Filed: Jun. 8, 1977

[30] Foreign Application Priority Data

Jun. 8, 1976 [GB] United Kingdom ..... 23547/76

[51] Int. Cl.[2] ..... F01D 5/28

[52] U.S. Cl. ..... 415/197; 415/214

[58] Field of Search ..... 415/197, 214

[56] References Cited

U.S. PATENT DOCUMENTS

| | | | |
|---|---|---|---|
| Re. 14,988 | 11/1920 | Parsons | 415/197 X |
| 1,912,408 | 6/1933 | Schelhammer | 415/197 X |
| 3,160,106 | 12/1964 | Ashworth | 415/197 X |

FOREIGN PATENT DOCUMENTS

| | | | |
|---|---|---|---|
| 240112 | 8/1962 | Australia | 415/197 |
| 426523 | 4/1935 | United Kingdom | 415/197 |
| 473253 | 10/1937 | United Kingdom | 415/197 |

*Primary Examiner*—Everette A. Powell, Jr.

*Attorney, Agent, or Firm*—Sughrue, Rothwell, Mion, Zinn and Macpeak

[57] ABSTRACT

A centrifugal pump for pumping a mixture of abrasive particles in a liquid has a casing affording a cylindrical pumping chamber with an inlet and outlet, and an impeller of circular form disposed in the chamber for rotation about the longitudinal axis thereof, with radially extending vanes for drawing the mixture into the chamber through the inlet and expelling it via the outlet, the dimensions of the impeller and pumping chamber being such that the clearances between the impeller and chamber wall are small. The inside wall of the chamber, and the impeller carry an outer layer of rubber or like abrasive-resistant material.

4 Claims, 8 Drawing Figures

CENTRIFUGAL PUMPS

BACKGROUND OF THE INVENTION

1. Field of the Invention

This invention relates to centrifugal pumps for liquids and in particular, though not exclusively, to such pumps for use in supplying a mixture of abrasive particles in a liquid.

It is an object of the invention to provide an improved form of centrifugal pump which is particularly suitable for the application described above.

2. Summary of the Invention

Various features provided by the pump of the invention are set out below.

The pump has a casing which provides a pumping chamber of cylindrical form and an impeller of circular form is disposed in the chamber for rotation about an axis coincident with the longitudinal axis of the chamber. The chamber has an inlet and an outlet and a number of substantially radially extending vanes on the impeller draw liquid and abrasive into the chamber through the inlet and expel this mixture via the outlet. The dimensions of the impeller and pumping chamber are such that the clearance between the outer periphery of the impeller and the adjacent wall of the pumping chamber is from $\frac{1}{8}$ to $\frac{5}{8}$ inches and the clearance between the radially extending edges of the impeller vanes and the adjacent axially facing ends of the pumping chamber is from 1/16 to $\frac{3}{8}$ inches.

The impeller may be mounted on a vertical shaft which extends through to the top of the pump casing by passing through a sealing passage which permits a certain amount of the liquid and abrasive from the pumping chamber to escape to discharge between the shaft and the wall of the sealing passage so that the passage is sealed against the intake of air.

The impeller may comprise a circular disc with a first series of circumferentially spaced radially extending vanes on one side of the disc and a second series of smaller circumferentially spaced radially extending vanes on the other side. The first series of vanes are arranged to do the major part of the pumping while the second set of vanes although doing some pumping are mainly arranged to generate a back pressure which opposes the tendency of the first set of vanes to pump liquid out through the sealing passage. This generation of a back pressure ensures that the sealing passage is not subjected to the full pressure present in the main part of the pumping chamber.

The impeller may comprise a load bearing metal portion and an outer layer of rubber or other rubber-like or plastics material which resists abrasion by the abrasive material. The securing of the abrasive resistant layer to the load-bearing portion may be assisted by providing the load-bearing portion with recesses or similar formations which provide a key for the outer abrasive resistant layer.

The inside of the pumping chamber may also be provided with an abrasion resistant rubber or other plastics layer as may be the walls of the sealing passage which also come in contact with the liquid and abrasive mixture.

The pump casing may be arranged to be split into two parts about a radially extending plane which is perpendicular to the longitudinal axis of the pumping chamber. By appropriate axial positioning of the plane on which the pump casing divides it is possible to arrange that the first series of impeller vanes which provide most of the pumping action do not direct the majority of the pumped fluid across the join between the casing parts. This assists in reducing turbulence inside the pumping chamber.

Also with a two part casing as described above it is possible to arrange the shape of the two parts of the casing to be such that they can be cast in a simple die which does not require the use of loose cores and which need not be split into more than two portions to enable the casing parts to be removed after casting.

BRIEF DESCRIPTION OF THE DRAWINGS

One example of a pump provided by the invention will now be described with reference to the accompanying drawings in which.

DESCRIPTION OF THE PREFERRED EMBODIMENT

Figure 1:
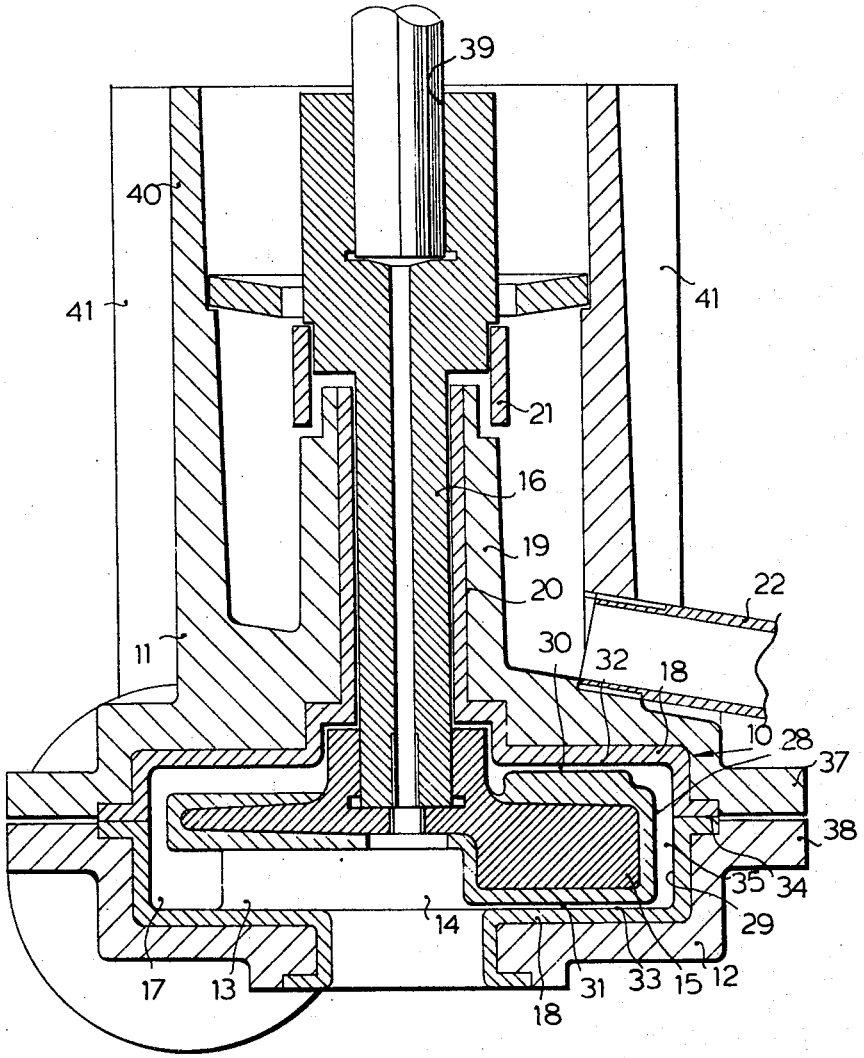
FIG. 1 is a vertical section through such a pump.
Figure 2:
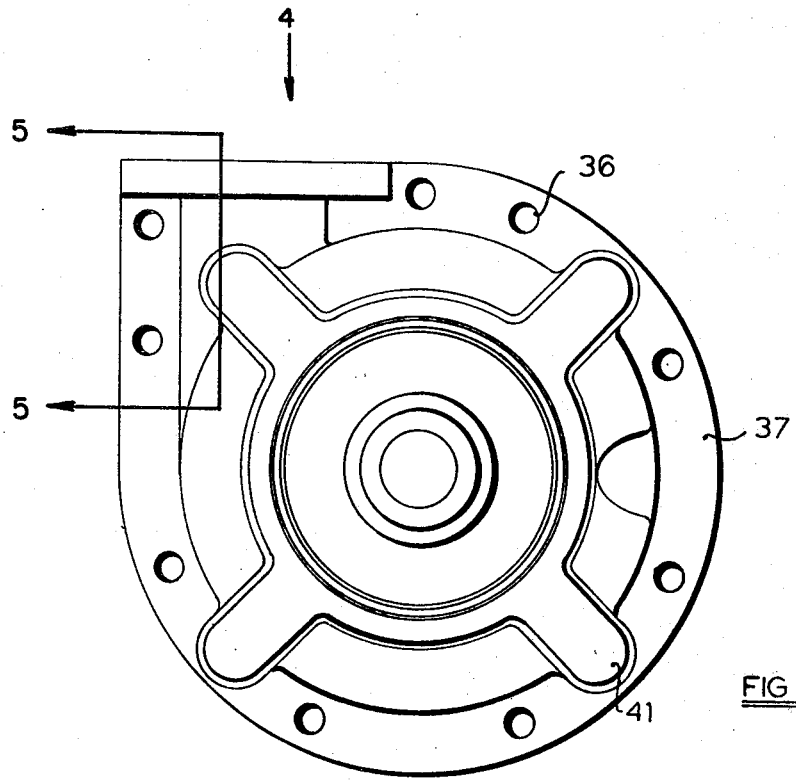
FIG. 2 is a plan view of the pump casing.
Figure 3:
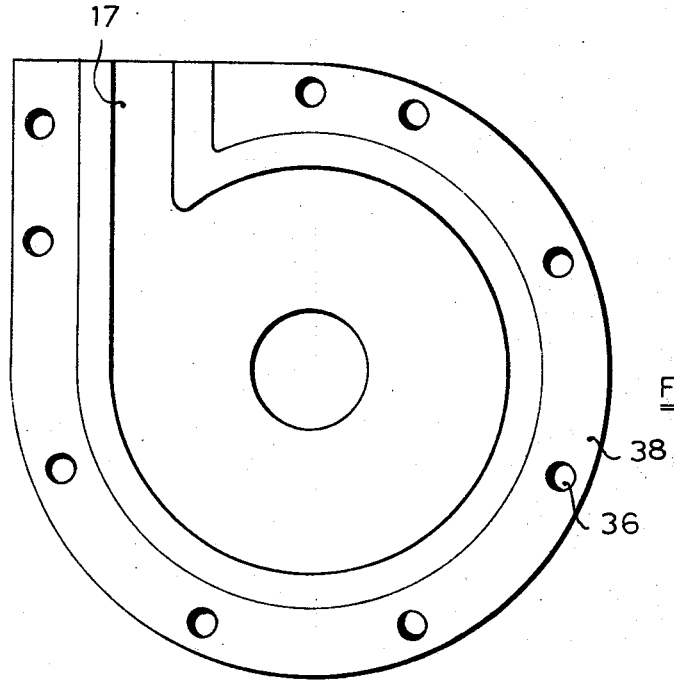
FIG. 3 is a plan view of the lower half of the pump casing showing the inside of the casing.
Figure 4:
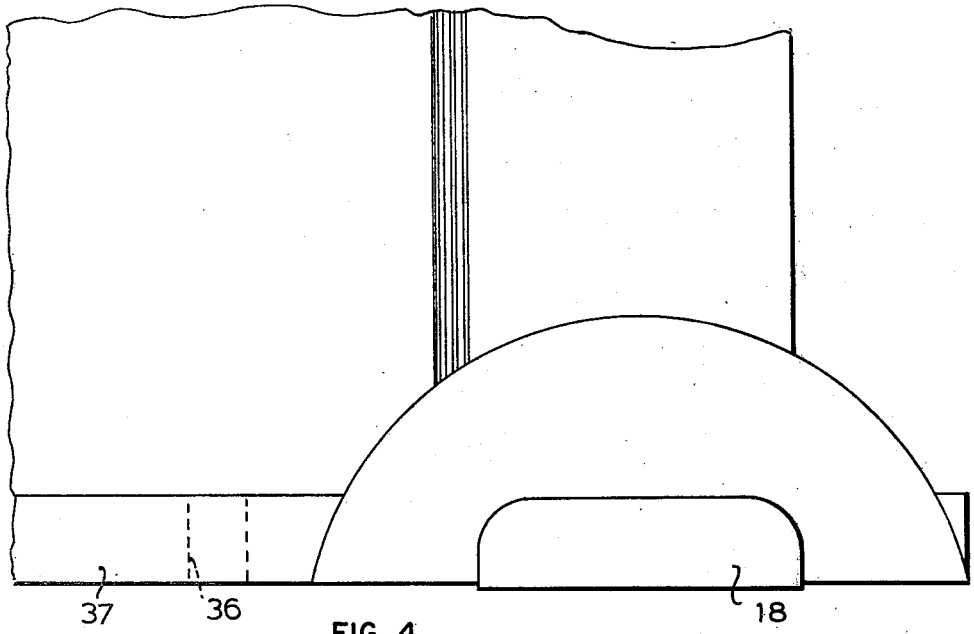
FIG. 4 is an elevational view of the upper part of the casing in the direction of the arrow 4 in FIG. 2, partly broken away.
Figure 5:
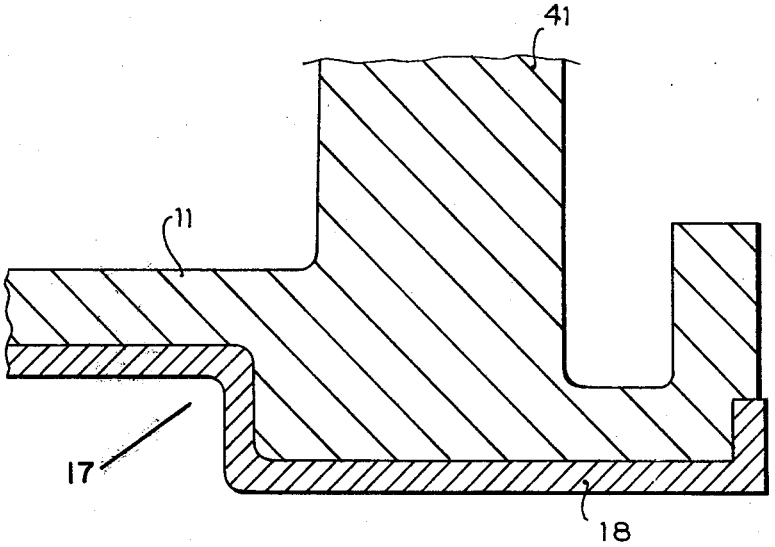
FIG. 5 is a sectional view taken on the line 5—5 of FIG. 2.
Figure 6:
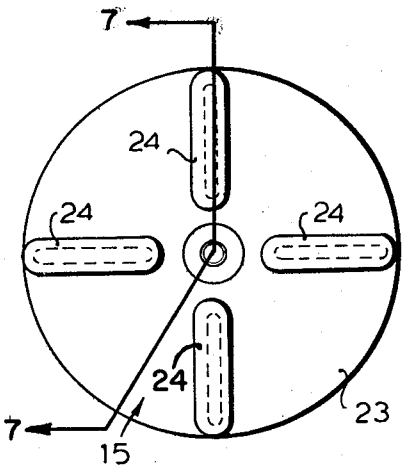
FIG. 6 is an underneath plan view of the impeller of the pump shown in FIG. 1.

Referring to FIG. 1 the pump comprises a casing 10 having an upper part 11 and a lower part 12 both these parts are aluminium castings produced by the gravity-base technique. The casing has a pumping chamber 13 into which the liquid and abrasive mixture is drawn via an inlet 14. An impeller 15 mounted on a shaft 16 draws the liquid and abrasive mixture into the inlet 14 and expels this mixture from the chamber 13 via an outlet 17.

As can be seen from FIG. 1 the internal walls of the pumping chamber 13 and also the inlet and outlet of the chamber are lined by a rubber layer 18 which has a hardness of 40/80 shore. The shaft 16 extends through a boss portion 19 provided on the upper part 10 of the casing. The passage 20 in the boss 19 through which the shaft 16 extends is also lined by the rubber layer 18 and clearance is provided between the rubber layer and the outer surface of the shaft so that a small proportion of the liquid and abrasive mixture within the pumping chamber 13 is pumped out of the chamber between the shaft and the rubber layer 18 which lines the boss 19. This liquid which leaves the pumping chamber between the shaft 16 and the rubber layer 18 is deflected downwardly by a ring 21 carried on the shaft 16 and leaves the casing via an outlet 22.

Figure 7:
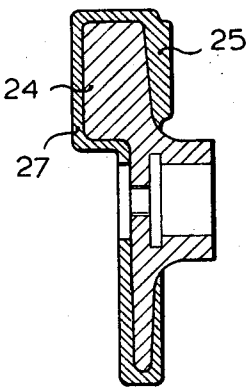
FIG. 7 is a sectional view of the impeller taken on the lines 7—7 of FIG. 6.
Figure 8:
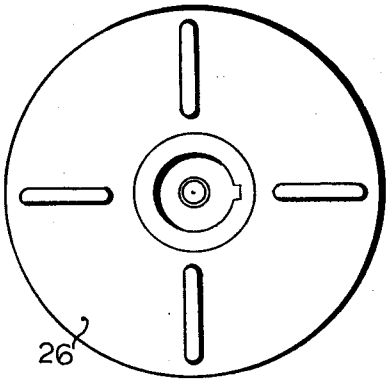
FIG. 8 is a top plan view of the impeller.

By pumping a small quantity of liquid and abrasive out of the chamber 13 around the shaft 16 the entry of air into the chamber around the shaft 16 is prevented. The construction of the impeller 15 can be seen from FIG. 1 and also from FIGS. 7 to 9. Basically the impeller consists of a disc 23 with a first series of radially extending vanes 24 on one side of the disc and a second series of smaller radially extending vanes 25 on the other side of the disc. It is the larger vanes 24 which are arranged to provide the majority of the pumping action, the smaller vanes 25 being arranged, in addition to providing some pumping, to generage a back pressure which opposes the tendency of the first vanes 24 to pump the liquid and abrasive out of the casing between the shaft 16 and the rubber lining 18. This ensures that the clearance between the shaft 16 and the lining 18 is not pressurised with the full pumping pressure of the chamber 13.

The impeller has a load-taking structural portion 26 which is shown separately in FIG. 9. This is manufactured from aluminium as a gravity-base die casting. The structural portion 26 is covered with a rubber protective layer 27 which again has a shore hardness of 40/80.

As can be seen from FIG. 1 the impeller is a relatively close fit within the pumping chamber 13, the spacing between the outer periphery 28 of the impeller and the adjacent surface 29 of the casing being between $\frac{1}{8}$ and $\frac{5}{8}$ inches and the clearance between the radially extending edges 30 and 31 of the two sets of vanes and the adjacent surfaces 32 and 33 of the casing being between 1/16 and $\frac{3}{8}$ inches. As can be seen from FIGS. 1 and 12 the smaller set of vanes 25 are in fact formed entirely from rubber.

The interface 34 between the two parts of the casing 10 is positioned so that the main set of pumping vanes 24 do not cause the majority of the liquid and abrasive pumps by the impeller to be passed across the edge 35 of the join between the two casing parts which is exposed in the chamber 13. This assists in reducing the turbulence in the pumped liquid and abrasive and generally improves the efficiency of the pump.

The two parts 11 and 12 of the pump casing are so shaped that they can each be cast in a simple two part mold which does not require the use of a loose core. The two parts of the casing are bolted together by bolts not shown which extend through holes 36 provided in flanges 37 and 38 on the two casing parts.

The shaft 16 is driven by an electric motor (not shown) whose output shaft enters a socket 39 in the upper end of the shaft 16. This motor is supported on an upper sleeve-like portion 40 of the casing part 11 which is provided with circumferentially spaced reinforcing lobes 41. The impeller 15 is thus supported in its operational position within the chamber 13 by its attachment to the output shaft of the electric motor.

We have found that by providing a pump of the construction described above it is possible to achieve a greatly improved pumping efficiency compared with previous pumps for the supplying of the liquid and abrasive mixture. We believe that a significant factor in the improved performance of the pump is the fact that the clearance between the impeller and the casing are appreciatively smaller than in the previous pumps and that by the use of an appropriate rubber or other plastics protective layer on the casing and impeller it is possible for the pump to operate with these greatly reduced clearances without the protective layer swelling and causing the pump to jam.

The primary application of the pump described above is in the abrading field where the pump can be used to supply a mixture of liquid and abrasive to an abrading gun from which the mixture is directed onto the surface of a workpiece to be abraded.

I claim:

1. A centrifugal pump for pumping a mixture of abrasive particles and a carrier fluid, the pump comprising a casing having a hollow cylindrical interior defining a central axis, an axially disposed inlet and a tangentially disposed outlet, and an impeller rotatably mounted in the interior of the casing about said axis and comprising an imperforate disc of a diameter closely approaching the internal diameter of the casing and a plurality of imperforate rectangular blades extending radially of the disc to the circumference thereof, the radially outermost edges of the blades being parallel to and almost touching the cylindrical interior wall of the casing so that the rotating impeller, in use, sweeps substantially the entire volume of the interior of the casing, both the interior of the casing and the impeller being provided with a coating of abrasion resistant rubberlike material.

2. A pump according to claim 1 wherein the impeller sweeps a volume extending to within $\frac{1}{8}$ to $\frac{5}{8}$ inches of the interior wall of the casing.

3. A pump according to claim 1 wherein said vanes comprise a first plurality of main vanes disposed on one face of the disc facing said axial inlet and a second plurality of subsidiary vanes, smaller in area than the main vanes, on the opposed face of the disc, and adapted to generate a back pressure on rotation of the impeller, the impeller shaft extending vertically upwardly from the impeller and a passageway being provided in the casing to journal the shaft, there being a clearance between the shaft and the passageway to permit a small proportion of said mixture to escape from the casing under said back pressure and seal the passageway against intake of air.

4. A pump according to claim 1 wherein the casing is formed in two cylindrical parts, joined together at a peripheral joint, said joint being axially positioned away from the portion of the peripheral volume swept by said main vanes.

* * * * *